US007481726B2

(12) United States Patent
Hawk

(10) Patent No.: US 7,481,726 B2
(45) Date of Patent: Jan. 27, 2009

(54) HOPSCOTCH-LIKE GAME

(76) Inventor: August C. Hawk, 2068 Olive Ave., Lakewood, OH (US) 44107

( * ) Notice: Subject to any disclaimer, the term of this patent is extended or adjusted under 35 U.S.C. 154(b) by 0 days.

(21) Appl. No.: 11/356,747

(22) Filed: Feb. 17, 2006

(65) Prior Publication Data

US 2006/0194651 A1 Aug. 31, 2006

Related U.S. Application Data

(60) Provisional application No. 60/653,855, filed on Feb. 17, 2005.

(51) Int. Cl.
*A63B 67/00* (2006.01)

(52) U.S. Cl. ..... 473/414

(58) Field of Classification Search ..... 473/414, 473/150, 218, 452; 273/444; 482/23, 142, 482/148

See application file for complete search history.

(56) References Cited

U.S. PATENT DOCUMENTS 3,484,106 A * 12/1969 Foley et al. ..... 273/444
3,515,385 A * 6/1970 Gunderson ..... 473/414
3,879,034 A * 4/1975 Petrusek ..... 273/444
4,009,880 A * 3/1977 Lammersen ..... 273/444
5,156,409 A * 10/1992 Barnes ..... 273/444

* cited by examiner

*Primary Examiner*—Mitra Aryanpour
(74) *Attorney, Agent, or Firm*—Dwight A. Stauffer

(57) ABSTRACT

A game apparatus and method wherein one or more players move along a path according to predetermined rules of movement. The path is a sequence of adjacent boxes outlined in the path; and graphics are associated with each box, wherein the graphics designate one or more body parts of the player moving along the path that must touch a playing surface of the associated box. Preferably the graphics also specify one or both of the location and the orientation of the designated body part's touch. The boxes are movable tiles having a plurality of two or even three dimensional shapes and sizes which can be releasably attached to each other. Thus game players can create a myriad of unique game paths with a wide range of challenge level for maintaining interest, encouraging creativity and exercise.

15 Claims, 2 Drawing Sheets

HOPSCOTCH-LIKE GAME

CROSS-REFERENCE TO RELATED APPLICATIONS

This application claims the benefit of U.S. Provisional Patent Application No. 60/653,855, filed Feb. 17, 2005 by August C. Hawk.

TECHNICAL FIELD OF THE INVENTION

The present invention relates to recreational game equipment and a method of playing said game, and, more particularly a game involving physical activity for one or more players.

BACKGROUND OF THE INVENTION

The game commonly called "Hopscotch" in the United States is well known as a children's playground game. Typically a path of approximately square boxes are marked on the ground (e.g., using chalk or paint). The marked boxes are drawn edge to edge to form a linear path one box wide except for optional places where two boxes are placed laterally together as a side-by-side pair. A typical set of game rules includes the following. A player must hop on one foot along the game path from a starting box to the next box to the next box and so on until reaching the outermost box (i.e., the box furthest away from the starting box). Upon reaching the outermost box, the player must turn around and hop back to the starting box. While hopping, the player's foot may not touch a box's outline; the player must keep moving from box to box; and no part of the player's body other than the hopping foot may touch the ground. If any rule is violated while a player is moving along the path, the player's turn ends. Where a pair of boxes are placed side-by-side, then the player must hop into one of them, then hop sideways into the other one of them, then continue hoping forward into the next box along the path. Optional rules require the player to put both feet down into paired boxes: the left foot into the box on the player's left, and the right foot into the box on the player's right. The boxes along the path may be numbered in sequence, in which case the player must hop into the boxes in the order of the numbered sequence, and continuing in reverse order after turning around in the outermost (highest numbered) box. The first player to move according to the rules through the entire path in one turn wins the game. Rule variations include a marker (e.g., a small stone) that is thrown or placed into a box and must then be retrieved while the player hops along the path. Alternatively, each player may have a unique marker that he/she uses to mark the box at which the player's turn ended. Because of the hopping required, the game of Hopscotch provides physical exercise and helps develop bodily coordination and a sense of balance.

Compared to Hopscotch, an existing game that involves less physical exercise, but more coordination and balance has been marketed by Milton Bradley under the name of Twister™. In this game there is a floor mat with twenty-four large colored circles on it, arranged in four rows, with each row having six circles of the same color, different from the colors in the other rows (e.g., a red row, a blue row, a yellow row, and a green row). Like Hopscotch, the circles are "boxes" wherein a designated body part (like the hopping foot) must be placed according to a sequence determined by the rules of play, and a player's turn ends if any undesignated part of the body touches the ground (mat). Unlike Hopscotch, two to four player's take their turns simultaneously, and the winner is the last one of the players to end their turn. Furthermore, there is no hopping between boxes. Instead a referee spins a spinner that randomly determines both a body part and a color, whereupon all players must simultaneously move their designated body part to place it in a box of the designated color. Only four body parts are designated: left hand, right hand, left foot, and right foot. Except for the case of team play, only one body part at a time may be placed in a box.

Although Twister™ is enjoyed by teens and adults much more than Hopscotch, both games would appeal to a larger audience if made more challenging. Therefore it is an object of the present invention to improve the game of Hopscotch to make it more challenging for teens and adults, thereby making it more interesting to them. It is a further object to include more physical exercise as a part of the game. It is also an object to add a variety of game elements that can be creatively and imaginatively employed by the players such that the game is always fresh and new, and can be made more or less difficult depending upon the abilities of the players.

BRIEF SUMMARY OF THE INVENTION

According to the invention a game is disclosed wherein one or more players move along a path according to predetermined rules of movement, and the inventive game apparatus comprises: a sequence of adjacent boxes outlined in the path; and graphics associated with a box, wherein the graphics designate one or more body parts of the player moving along the path that must touch a playing surface of the associated box.

Further according to the invention the graphics specify either the location of the designated body part's touch, or the orientation of the designated body part's touch. Even further, the graphics specify either or both the location of the designated body part's touch, and the orientation of the designated body part's touch.

Further according to the invention the boxes have a plurality of outline shapes and sizes.

Further according to the invention the boxes are movable tiles having a plurality of two dimensional shapes and sizes, preferably selected from the group consisting of square, triangular, trapezoidal, and rectangular shapes. Preferably a tile edge length is within the range of twelve inches to thirty inches.

Further according to the invention the tiles have a plurality of three dimensional shapes and sizes.

According to the invention the game apparatus further comprises releasably interlocking edges around each tile, such that two adjacent tiles can be releasably attached to each other. Preferably hook and loop fabric is used for the releasably interlocking edges of adjacent tiles. Further preferably, a strip of the loop fabric is affixed to an underside of the tile along each outside edge of the tile; and a strip of the mating hook fabric is formed into an attachment strip that is wide enough to overlap both a first strip of the loop fabric affixed along an edge of a first one of two adjacent tiles, and a second strip of the loop fabric affixed along an edge of a second one of two adjacent tiles.

According to the invention a method for playing a game is disclosed wherein one or more players move along a path, the method comprising the steps of: forming a sequence of adjacent boxes in the path; associating instructional graphics with a box, wherein the graphics designate a body part; requiring that the one or more players take turns moving along the path from box to adjacent box; and requiring that the player moving into the box must only touch a playing surface of the box and furthermore must only touch with a body part of the player that is designated by the graphics associated with the box.

According to the invention, the method further comprises the step of requiring that the designated body part of the player moving into the box must touch in a location in the box that is specified by the graphics associated with the box.

According to the invention, the method further comprises the step of requiring that the designated body part of the player moving into the box must touch in an orientation in the box that is specified by the graphics associated with the box.

According to the invention, the method further comprises the step of requiring that the designated body part of the player moving into the box must touch in a location in the box and in an orientation in the box according to specifications indicated by the graphics associated with the box.

According to the invention, the method further comprises the step of requiring that the player must move continuously from box to adjacent box, without pausing in any box for more than a short predetermined amount of time.

According to the invention, the method further comprises the step of requiring that the player must touch only a single box at any time.

According to the invention, the method further comprises the steps of allowing the player moving along the path to continue moving from box to adjacent box until the player's turn is ended by violating any one of the required steps of the game method; and declaring that a player reaching an end box of the path is a winner of a game session.

According to the invention, the method further comprises the step of requiring that a player can only be a winner if the player reaches the end box by moving from a start box at the beginning of the path to the end box in one turn.

According to the invention, the method further comprises the steps of forming the path of adjacent boxes by using one or more movable tiles for each box; and releasably attaching adjacent tiles to each other by using releasably interlocking edges on the tiles.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity.

Elements of the figures can be numbered such that similar elements (including identical, or related variants) may be referred to with similar numbers in a single drawing. For example, each of a plurality of elements collectively referred to as 199 may be referred to individually as 199*a*, 199*b*, 199*c*, etc. Such relationships, if any, between similar elements in the same or different figures will become apparent throughout the specification, including, if applicable, in the claims and abstract.

Figure 1A:
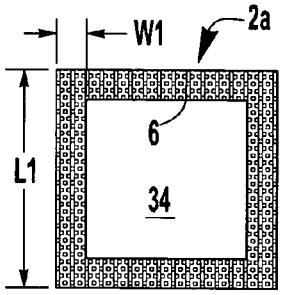
Figure 1B:
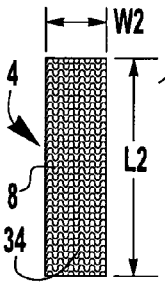
Figure 2:
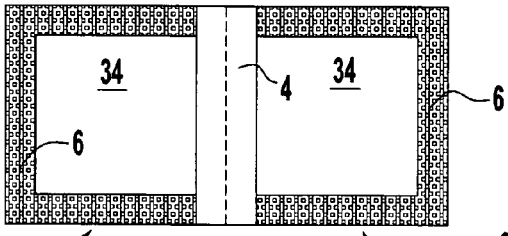
Figure 3:
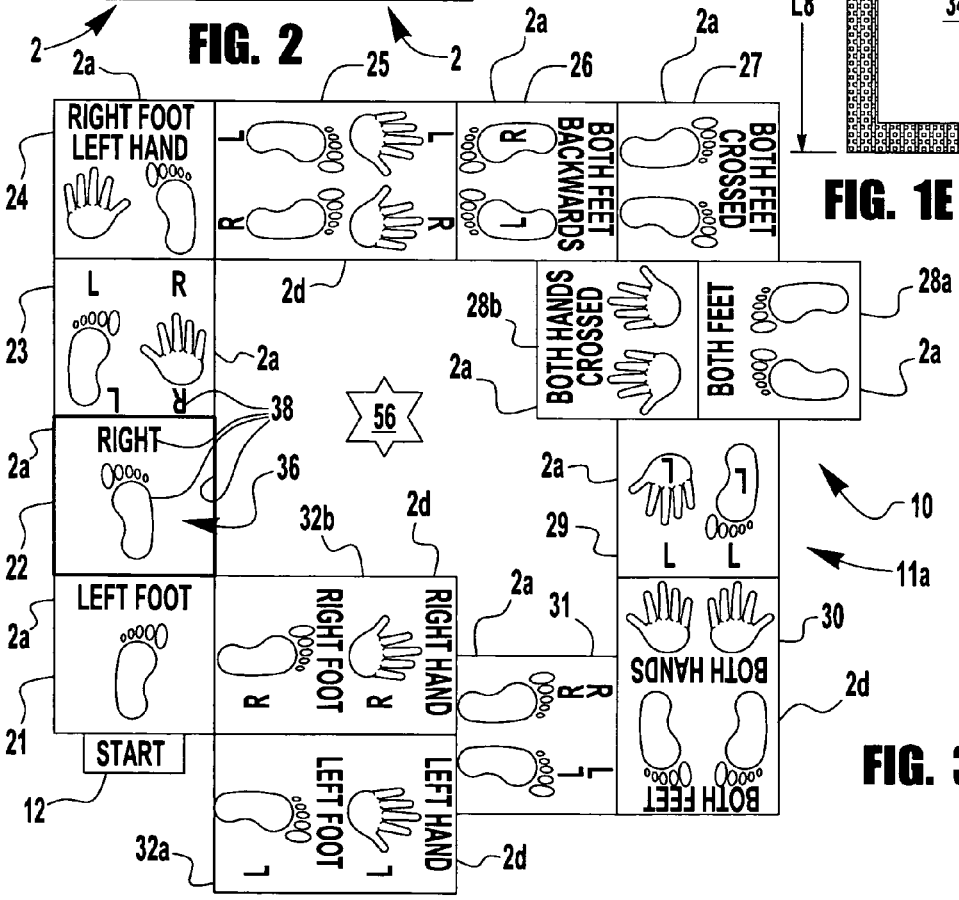
Figures 4, 5, 6, 7, 8:
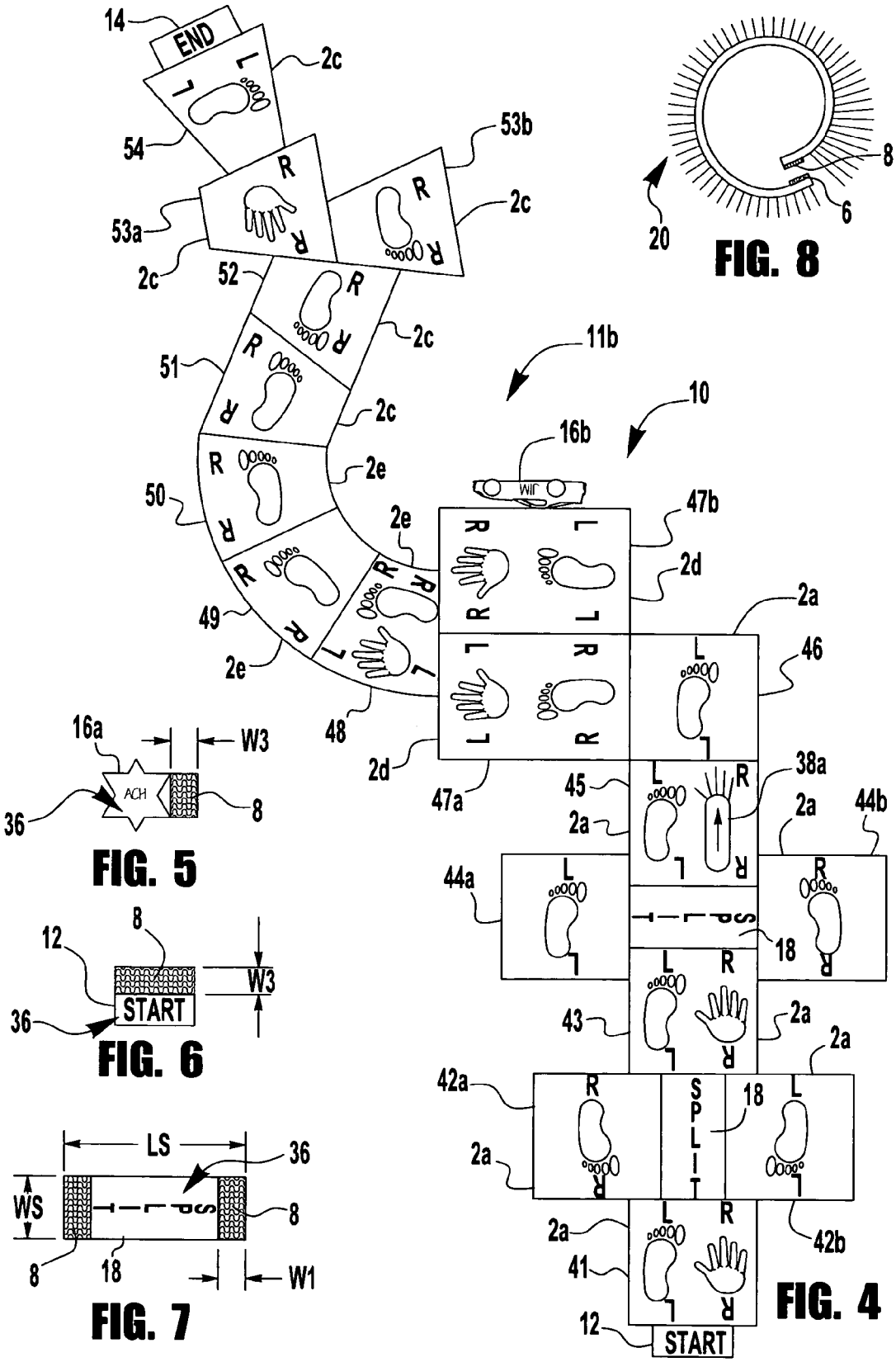

The structure, operation, and advantages of the present preferred embodiment of the invention will become further apparent upon consideration of the following description taken in conjunction with the accompanying drawings, wherein:

FIGS. 1A, 1C, 1D, and 1E are bottom views of several differently shaped tiles, according to the invention;

FIG. 1B is a top view of an attachment strip for interlocking edges of the tiles, according to the invention;

FIG. 2 is a bottom view showing two of the tiles of FIG. 1A that have edges interlocked by the attachment strip of FIG. 1B, according to the invention;

FIGS. 3 and 4 show top views of the tiles interlocked to form exemplary game paths, plus a winner's circle game element in the center of FIG. 3, all according to the invention;

FIG. 5 shows a player token, according to the invention;

FIG. 6 shows a start label, according to the invention;

FIG. 7 shows a splitter, according to the invention; and

FIG. 8 is a side view of a glow-band wrist or ankle strap, according to the invention.

DETAILED DESCRIPTION OF THE INVENTION

The present invention is a physically active and creatively challenging game related to the game of Hopscotch, but improved in complexity and playability. It will be seen that the various embodiments of the game are suitable and interesting for people of all ages, and can promote healthy, even quite vigorous exercise. Preferred embodiments of the game playing apparatus (elements) and game rules are described herein, but it should be understood that these embodiments are only examples and that all functionally equivalent apparatus elements and rules should be considered within the scope of the invention as claimed. Just as the term "game" is commonly given a variety of meanings according to the context in which it is used, so the term "game" is used herein to mean, either separately or in combination: physical elements of game apparatus, rules governing the game method of play, the overall concept of the game, the activity of game players taking part in playing the game, and a session of game playing involving one or more turns taken by the game player or players.

Game Apparatus

In general, the preferred embodiment of the inventive game 10 is movable (portable) and can be played anywhere, because the playing surface is imprinted on a plurality of interconnected pieces of material called tiles (collectively referenced by the number 2). A less preferred variant embodiment is implemented by simply drawing, with chalk, for example, the desired arrangement of boxes on the ground, or on a unitary floor mat that would be portable.

Like Hopscotch, the game 10 involves moving along a path 11 (collective reference) of boxes (e.g., boxes 21-32 for path 11*a* in FIG. 3; or boxes 41-54 for path 11*b* in FIG. 4). Although a fixed pattern of boxes 21-32, 41-54 for the game path 11 is one possible game embodiment, a preferred embodiment of the game 10 encourages creativity and variability by providing a variety of movable tiles 2 from which one tile 2, or a combination of tiles 2 can be selected for each box 21-32, 41-54, and arranging the tiles 2 in sequence to form a temporary path 11 as determined by the players (or game officials in formal play) in order to create a unique game-playing path 11 whenever and wherever desired.

The tiles 2 are removably held in position along the path 11, preferably by releasably attaching the tiles 2 one to another by interlocking edges 6, 8. The interlocking edges 6, 8 could be, for example, puzzle-like knob and socket-shaped edges (not shown), or for example could be a tacky or self-adhesive underside of the tiles 2 for sticking onto a floor or a unitary mat (also not shown). A preferred embodiment of the interlocking edges 6, 8 is illustrated in FIGS. 1A through 2 (1A-2). An underside 34 of each tile 2 (illustrated in a plurality of two-dimensional shapes in FIGS. 1A-1E) has a loop fabric 6 permanently affixed along each tile edge, and an attachment strip 4 of hook fabric 8 is dimensioned to overlay the loop fabric 6 edges of two adjacent tiles 2 for releasably attaching the two tiles 2 edge to edge as shown in FIG. 2. Thus any two tiles 2 having edge lengths L1, L3, L4, L5, L6, L7, L8 and loop fabric 6 width W1 can be releasably attached together by an attachment strip 4 that has a length L2 and a width W2, wherein the length L2 is less than or preferably approximately equal to the shortest of the edge lengths L1, L3, L4, L5, L6, L7, L8 and the width W2 is preferably approximately equal to twice the width W1. It can be seen that this system allows temporary attachment of any two tiles 2 along any edge of each tile 2. Furthermore, this method for interlocking tile edges is not visible on a top side 36 of each tile 2, thereby leaving the entire top side 36 blank for imprinting graphics 38. The commercial product named Velcro® is an example of a two part releasably attaching system comprising a hook fabric part (like 8) with a surface of tiny plastic hooks that will hook into a corresponding loop fabric part (like 6) having a surface of looped plastic thread.

Referring to FIGS. 1A-1E, 3 and 4, examples of several differently shaped tiles 2 are shown. Of course these are only examples of a wide variety of possible two dimensional shapes. Furthermore, the tiles 2 may also have a plurality of three dimensional shapes, wherein the thickness (i.e., height off the ground) of the tile 2 is varied as well as the two dimensional footprint on the ground. For example, tiles 2 could be three-dimensionally shaped steps of different heights such that adjacent step-shaped tiles 2 could be formed into an ascending or descending staircase. FIGS. 1A-1E show the underside 34 of each tile 2*a*-2*d*, while FIGS. 3 and 4 show the top side 36 of tiles 2. All of the tiles 2 have some form of interlocking edges 6, 8, although the hook and loop fabric implementation of it is only visible in FIGS. 1A-2. The tiles 2 are made of a suitable material such as closed cell plastic foam, preferably about a quarter inch thick and rigid enough to prevent buckling when it is hopped upon by players. For three dimensional tiles 2, the height is preferably provided by a semi-rigid plastic form, suitable for bearing the weight of intended players. Also preferably, the tiles 2 have a slip-resistant underside 34, for example rubberized. The hook and loop fabric embodiment of the interlocking edges 6, 8 is as thin as possible so as to avoid significant raising of tile 2 edges.

Figure 1C:
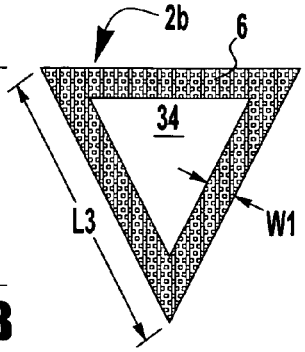
Figure 1D:
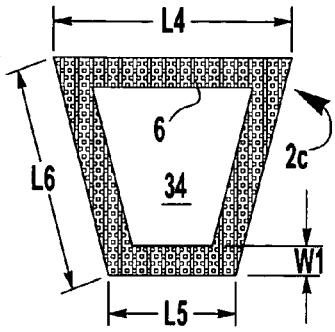
Figure 1E:
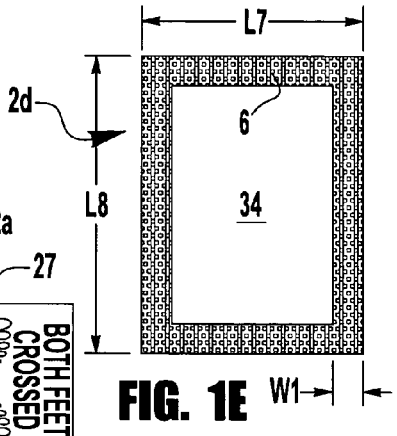

FIG. 1A shows a square tile 2*a* with an edge length L1 on all four edges. FIG. 1C shows a triangular tile 2*b*, preferably equilateral with an edge length L3 on all three edges. FIG. 1D shows a trapezoidal tile 2*c*, preferably isosceles with two angled edge lengths L6, a long base edge length L4 and a shorter tip edge length L5. FIG. 1E shows a rectangular tile 2*d*, preferably regular with two long edge lengths L8 and a shorter edge length L7. FIG. 4 shows an annular arcuate tile 2*e* that has the same overall dimensions as the trapezoidal tile 2*c* (boxes 48-50), except that the base edge and tip edge are concentric arcs having chord lengths of L4 and L5, respectively. By comparing the use of the annular arcuate tiles 2*e* to form boxes 48-50, with the use of the trapezoidal tiles 2*c* to form boxes 51-54, it can be seen that tiles 2 that are polygons (having all straight edges) enable the most flexibility in their use since adjacent straight edges are more easily attached together than curved edges. Thus tiles 2 having one or more curved edges (e.g., tile 2*e*) can be used, but are less preferred than polygon shaped tiles 2 (e.g., 2*a*, 2*b*, 2*c*, 2*d*). For the sake of convenience in path forming, it is desirable that the edge lengths L3, L4, and L7 be approximately equal to the edge length L1 of the square tile 2*a*. Furthermore, it is convenient if the trapezoidal tile 2*c* has angled edge lengths L6 that are also approximately equal to the lengths L4 and L1; and if the rectangular tile 2*d* has a long edge length L8 that is approximately equal to twice the lengths L7 and L1. The length L1 is preferably within the range of twelve inches to thirty inches.

FIGS. 3 and 4 show examples of two possible game paths 11. In FIG. 3, a first example path 11*a* uses square tiles 2*a* and rectangular tiles 2*d* to form a path 11*a* that loops back on itself. In FIG. 4, a second example path 11*b* uses square tiles 2*a*, trapezoidal tiles 2*c*, rectangular tiles 2*d*, and annular arcuate tiles 2*e* to form the path 11*b*. A start label 12 is used to indicate the beginning of both paths 11*a*, 11*b*, and an end label 14 is used to indicate the end of the second path 11*b*. Also a splitter tile 18 is employed in the second path 11*b*. Referring to FIG. 6, the start label 12 is shown with an optional tab of hook fabric 8 for releasably attaching the start label 12 to the loop fabric 6 on the underside 34 of any tile 2. The top surface 36 of the start label 12 has the word START imprinted on it, although any graphic that indicates starting can be used, for example arrow symbols. Similarly, the end label 14 (shown in FIG. 4) may have a tab of hook fabric 8, or without one the end label 14 could simply be placed next to the last box (e.g., 54) of the path 11. The top surface 36 of the end label 14 has the word END imprinted on it, although any graphic that indicates ending can be used, for example a stop sign symbol. Referring to FIGS. 7 and 4, the splitter 18 has an edge length LS and an edge width WS. Along each width edge is a strip of hook fabric 8 that has a width W1 to match the width W1 of the loop fabric 6 on all of the tiles 2. In the illustrated embodiment, the splitter edge length LS is equal to the square tile edge length L1 plus twice the fabric strip width W1. This dimension enables the splitter 18 to be positioned as a double box tile separator in two orientations as shown in FIG. 4 between boxes 42*a* and 42*b*, and between boxes 44*a* and 44*b*, thereby holding tiles 2 together at two different separation distances, one of which (box 42*a*, 42*b*) is a distance determined by an arbitrary splitter width WS. Of course the tiles 2 of box 42*a*, 42*b*could be separated even farther than the splitter width WS, leaving some blank space in between. It can be seen that additional pieces of attachment strip 4 will be needed to help hold tiles 2 in place wherever the tiles 2 have adjacent edges. The splitter 18 can be made of relatively thin material, or if made of the same thicker material as the tiles 2, then the hook fabric strips 8 will be thin material that extends out from underneath the splitter 18. Alternatively the splitter length LS could be approximately equal to the square tile edge length L1, and the underside of the splitter 18 would have loop fabric strips 6 of width W1 along two or even all four of the splitter's edges. Of course, many alternative designs for a splitter 18 will be apparent to a game designer of ordinary skill given the inventive teachings herein.

An optional game element is a player token 16, exemplified by a star shaped token 16*a* (in FIG. 5), and a racecar shaped token 16*b* (in FIG. 4). The tokens 16 can be free-standing, or optionally have a tab of hook fabric 8 for releasably attaching the token 16 to the loop fabric 6 on the underside 34 of any tile 2. The tokens 16 are relatively small and are preferably made of any relatively thin material. A tab width W3 for the token 16 and also for the start and end labels 14, 16 is arbitrary and can be less than the width W1 since these elements do not need to be firmly secured in place as they will not be jumped upon. The player tokens 16 are used to mark how far a player has traveled along the path 11 before violating the rules of play, thereby ending their turn. Thus each player will need a unique token 16 that is identifiable as their own. The shape of the token 16 can do this, and/or a color on the top surface of the token 16. In addition to shapes like cars and stars, tokens 16 can be shaped and/or printed with graphics to resemble favorite cartoon or movie characters, sports figures, celebrities, etc. Preferably the tokens 16 are further personalized by graphics on the top surface 36, such as the player's name, initials, picture, etc. The surface 36 can be made paintable or receptive to markers, pens, and the like; and can be made of a material that is easily cut to shape by the player. Alternatively, custom designs can be professionally made to order and sold to players.

Referring to FIG. 3, another optional game element is a "Winner's Circle" 56, upon which the player winning a game session can stand for recognition. The Winner's Circle 56 may represent a circle, star, Olympic medal podium, etc.

Each box 21-32, 41-54 (preferably indicated by tiles 2) has instructional graphics 38 associated with it, preferably imprinted on a top game-playing surface 36 (which could be the ground, a mat, or the top surface of a tile 2). The graphics 38 indicate which part of a player's anatomy must be placed in the associated box 21-32, 41-54 (e.g., left hand, right foot, right forearm, head, buttocks, etc.), where on the associated box 21-32, 41-54 the body part must be placed (e.g., left side, front end, etc.), and in which direction the body part must be oriented (e.g., forward, backward, diagonal, sideways to left, etc.). The graphics 38 can be any desired combination of text, symbols/icons, arrows/line drawings, and the like. Referring to boxes 21-23 in FIG. 3, several examples of the graphics 38 are illustrated. For example, in box 21 the text instruction "LEFT FOOT" states the body part and a footprint symbol for a left foot indicates the forward orientation and central spot in the box. Of course the left foot symbol also indicates everything by itself, so the text could be left out, thereby making a tile 2 for that box universally applicable regardless of language and regardless of orientation of the box (text is hard to read sideways or upside down). A compromise is seen in box 23 where a right hand symbol and a left foot symbol are supplemented by somewhat symbolic text: "L" for left and "R" for right. Furthermore, upside down reading is obviated by including an upside down L and R. Box 22 spell out "RIGHT" in text but doesn't bother with the word "foot" since that is obvious from the right foot symbol. Another graphic 38 is a heavy outline optionally drawn around the edge of the tile 2 that forms the box 22. When tiles 2 are used, such an outline may help clarify the boundaries of the box 21-32, 41-54, although other graphics 38 (e.g., a body part symbol) already are there to indicate the necessary placement of the body part. Box 26 provides another example of graphics 38 that limit the use of a movable tile 2, since the text says "BACKWARDS", any other orientation of the tile 2*a* used for box 26 would be invalid because the feet would no longer be "backwards". Thus graphics 38 that do not include text instructions (other than maybe the symbolic text L and R) are preferred for the inventive game 10.

An interesting variation of the graphics 38 allows the game 10 to be played in the dark. For example the graphics 38 can be imprinted using glow-in-the-dark paint, or fluorescent paint can be used, lighted by a "black light". In order to be able to see the movements of a game player in the dark, bracelet-like wrist/ankle glow-bands 20 could be strapped onto the player's wrists and ankles or wherever else they are needed. Referring to FIG. 8, for example, the glow-band 20 is a simple strap with a hook and loop fabric 6, 8 closure. It can have glow-in-the-dark or fluorescent graphics 38, or even have an internal light source such as battery powered LEDs that can be set to stay on or to blink.

Other special effects can be added to the tiles 2 to add to the fun. For example, piezo-electric powered LEDs or sound generating chips can be imbedded in the tile 2 so that it responds to pressure with light or sound emission. For example, mechanically generated sound effects could also be incorporated, such as a "whoopee cushion" effect. For example, a smelly substance could be mechanically expelled from a re-fillable reservoir in the tile 2.

Since there are a relatively small number of body parts that can be practically used in the game, it is fairly easy to agree on universal symbols for each. For example, symbols in box 45 in FIG. 4 indicate a left foot forward on the left side of the box 45, and a right forearm forward on the right side of the box 45. For extra versatility in selecting body part and orientation combinations with a minimum number of differently printed tiles 2, game setup rules allow two or even more tiles 2 to be combined to form a box 21-32, 41-54. For example, the rectangular tile 2*d* that forms box 30 could be formed out of two square tiles 2*a* as in the double-tile box 28 wherein the tile 2*a* to a player's left is referenced 28*a*, and the tile 2*a* to a player's right is referenced 28*b*. Thus a player would be required to move (jump) from a cross-legged standing position in box 27 to a bent over position in double-tile box 28 wherein hands and feet must touch down approximately simultaneously with both feet in box portion 28*a*, uncrossed but oriented in the opposite direction of box 27, plus both hands in box portion 28*b*, crossed and oriented in the same direction as the feet; followed by jumping up and landing in box 29 on the left foot and left hand oriented as shown. Furthermore, the use of a double-tile box (e.g., 28, 32) adds more possibilities such as when the players decide that a double-tile box (e.g., 28, 32) is to be treated as a sequence of two separate boxes (e.g., 28*a*, 28*b*). In this case, for example, a player may be required to move (jump) from a cross-legged standing position in box 27 to box portion 28*a* (landing on both feet uncrossed, but oriented in the opposite direction) and then moving into box portion 28*b* (doing a cross-armed hand stand!) followed by coming down into box 29 (landing on the left foot and left hand oriented as shown).

In another example, double-tile boxes 32 could also be formed with four square tiles 2*a* instead of two rectangular tiles 2*d* as shown.

As seen in FIG. 4, double-tile boxes (e.g., 42, 44) that are spatially separated (e.g., with the splitter 18) can be used to force a player to put extra distance between simultaneously landing body parts, e.g., "doing the splits". Alternatively, players can agree to treat the split double-tile boxes (e.g., 42, 44) as a sequence of two separate boxes (e.g., box portion 42*a* followed by box portion 42*b*).

Method of Playing the Game

An example of preferred game instructions are as follows. This example assumes that tiles 2 are used to form the boxes 21-32, 41-54 of a path 11. Of course the boxes 21-32, 41-54 could also be formed (outlined) simply by drawing them on a playing surface 36 such as, for example, the ground.

(a) Arranging the tiles 2 for a new session of the game 10: The tiles 2 should form a single path 11 from a starting tile (optionally marked by a start label 12) to a finishing or end tile (optionally marked by an end label 14). Tiles 2 may be placed laterally together (side-by-side) perpendicular to the path 11 (e.g., forming a double-tile box 28, 32, 42, 44, 47, 53, e.g., forming a triple or quadruple-tile box). In the preferred version of the game 10, the laterally placed tiles 2 must show different body part(s) in each tile 2 such that both of the laterally placed tiles 2 could be simultaneously touched by a player. Thus it is preferred that laterally placed tiles 2 are played as if they were combined into a single box 21-32, 41-54. As explained above, optional rules would not have this body part limitation since the laterally placed tiles 2 would be played like independent boxes 21-32, 41-54 in an agreed-upon sequence.

(b) Object of the game 10: Players (any number, including one individual) take turns attempting to move according to the rules of movement from box 21-32, 41-54 to box 21-32, 41-54 as far as possible along the path 11, competing to see how far they can go in one turn, or to see who gets to the end of the path 11 first, thereby winning the game session.

(c) General rules: If any rule of movement is violated while a player is moving along the path 11, the player's turn ends, meaning that the player must stand aside and the next player's turn begins. In a preferred version of the game rules, each player must start each of their turns at the beginning 12 of the path 11, unless the player has won by traversing the entire path 11 from start 12 to finish 14 in a single turn. In a simplified version of the game rules, the player may mark the last box 21-32, 41-54 that they successfully moved to in a turn, and then will continue from the marked box 21-32, 41-54 on their next turn. A player may use their token 16 to mark their last box 21-32, 41-54 by placing the token 16 on or beside their last box 21-32, 41-54 or removably attaching their token 16 to an edge of a tile 2 in that box. For detecting turn ending rule violations, the players can either judge for themselves or all judge each other in a simple friendly game, or an official referee can be designated in a competitive game.

(d) Rules of movement: For the purpose of illustration, refer to the first example path 11*a* in FIG. 3, wherein the boxes 21-32 are arranged in sequence along the path 11*a*, and the playing surface 36 is within the bounds of the boxes 21-32. A statement that something is "designated" or "specified" in a box should be understood to mean that something is indicated by the graphics 38 associated with the box. Movement from box 21 to box 22 comprises starting with only the designated body part(s) touching the playing surface 36 of box 21, the designated body part(s) being approximately in the location (s) and orientation(s) that are specified in box 21; followed by approximately simultaneously placing the body part(s) designated in box 22 on the playing surface 36 of box 22 such that the designated body part(s) are approximately in the location (s) and orientation(s) that are specified in box 22. During this movement, no body part may touch the ground or the playing surface 36 other than the designated body parts in the specified locations and orientations on the playing surface 36 of the boxes 21 or 22.

The movement rules may be made more challenging by additionally requiring that a player be continuously moving from box 21-32, 41-54 to box 21-32, 41-54 without pausing in any box 21-32, 41-54 for more than a short predetermined amount of time (e.g., four seconds). Another challenging rule may be that only one box 21-32, 41-54 may be touched at any one time. This means that the player must hop or jump in order to move.

If the player succeeds in moving according to the rules of movement from box 21 to box 22, then the player should continue their turn by moving to the next box (i.e., box 23) according to the same rules of movement. The player continues moving along the path 11*a* from start 12 (box 21) toward the end 14 (box 32), until they violate the rules of movement (e.g., by falling down, or by putting the wrong body parts in a tile, etc.), thereby ending their turn.

CONCLUSION

The inventive game 10 can be implemented in different versions, for example basic and deluxe versions; or for example child, teen, adult, and competition versions; or for example themed versions based on characters, celebrities, different world locales, etc.; or for example a "racy" version incorporating clothing removal penalties and the like. Versions can be distinguished for example by size, quantity of tiles 2, quality of materials and graphics 38, complexity and difficulty of rules, etc. Expansion kits may also be offered, for example, with additional tiles 2, different tile shapes, extra features such as pressure sensitive LEDs in tiles 2, custom graphics 38, custom/personalized tokens 16, and different move specifications like hand stands, head stands, buttocks, forearm, knee, jumping jacks, spins, gymnastic moves, and so on.

The inventive game 10 can be used in many ways from a child's neighborhood game to a competitive adult tournament with official referees, to an individual exercise activity. Thus the objectives of providing exercise, challenge and heightened interest are met. The wide variety of game elements (e.g., tiles 2) exemplified by the present disclosure can be creatively and imaginatively employed by game players such that the game 10 is always fresh and new, and can be made more or less difficult depending upon the abilities of the players.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A method for playing a game wherein one or more players move along a path, one at a time, attempting to move as far along the path as possible while obeying predetermined rules of movement; the method comprising the steps of:

using a set of movable game tiles, each of which displays preprinted instructional graphics on a top surface, wherein the graphics designate at least one body part, but limited to a combination of body parts that can all be simultaneously placed on the tile by a single player;

creating a single path from start to finish by forming a sequence of adjacent boxes, wherein each box comprises one or more of the movable tiles, and has graphics associated with the box that are the sum of the instructional graphics preprinted on the one or more tiles of the box; and wherein the tiles of the box are selected such that the combination of body parts designated on all of the one or more tiles of the box can all be simultaneously placed by a single player within the bounds of the box; and the one or more players take taking turns moving along the path in sequence from box to adjacent box; according to rules of movement that comprise:

when moving into a box, the player must only touch a playing surface within the bounds of the box;

the player must only touch with a body part that is designated by the graphics associated with the box; and the player must approximately simultaneously touch with all of the body parts that are designated by the graphics associated with the box.

2. The method of claim 1, further comprising the step of:

requiring that the designated body part of the player moving into the box must touch in a location in the box that is specified by the graphics associated with the box.

3. The method of claim 1, further comprising the step of:
requiring that the designated body part of the player moving into the box must touch in an orientation in the box that is specified by the graphics associated with the box.

4. The method of claim 1, further comprising the step of:
requiring that the designated body part of the player moving into the box must touch in a location in the box and in an orientation in the box according to specifications indicated by the graphics associated with the box.

5. The method of claim 1, further comprising the step of:
requiring that the player must move continuously from box to adjacent box, without pausing in any box for more than a short predetermined amount of time.

6. The method of claim 1, further comprising the step of:
requiring that the player must touch only a single box at any time.

7. The method of claim 1, further comprising the steps of:
allowing the player moving along the path to continue moving from box to adjacent box until the player's turn is ended by violating any one of the required steps of the game method; and
declaring that a player reaching an end box of the path is a winner of a game session.

8. The method of claim 7, further comprising the step of:
requiring that a player can only be a winner if the player reaches the end box by moving from a start box at the beginning of the path to the end box in one turn.

9. The method of claim 1, wherein:
the tiles have a plurality of two dimensional shapes and sizes.

10. The method of claim 9, wherein:
the two dimensional tile shape is selected from the group consisting of square, triangular, trapezoidal, and rectangular shapes; and
a tile edge length is within the range of twelve inches to thirty inches.

11. The method of claim 1, wherein:
the tiles have a plurality of three dimensional shapes and sizes such that tiles can be of different thicknesses, thereby placing a tile's playing surface at a predetermined height above the ground, including heights sufficient to form rising stair steps from adjacent tiles of different heights.

12. The method of claim 1, further comprising the step of:
forming the path of adjacent boxes by releasably attaching adjacent tiles to each other using releasably interlocking edges on the tiles.

13. The method of claim 12, further comprising the step of:
using hook and loop fabric for the releasably interlocking edges.

14. The method of claim 13, further comprising the steps of:
affixing a strip of the loop fabric to an underside of the tile along an outside edge of the tile; and
forming a strip of the mating hook fabric into an attachment strip that is wide enough to overlap both a first strip of the loop fabric affixed along an edge of a first one of two adjacent tiles, and a second strip of the loop fabric affixed along an edge of a second one of two adjacent tiles.

15. The method of claim 1, further comprising the step of:
playing in the dark by providing glow-in-the-dark instructional graphics on the tiles and optionally also using glow-in-the-dark body part indicators worn by the player.

* * * * *